United States Patent [19]

Hellenberg

[11] Patent Number: 4,967,938

[45] Date of Patent: Nov. 6, 1990

[54] PAINT DISPENSING APPARATUS

[75] Inventor: Leen Hellenberg, Holland, Netherlands

[73] Assignee: Fluid Management Limited Partnership, Wheeling, Ill.

[21] Appl. No.: 380,974

[22] Filed: Jul. 17, 1989

[51] Int. Cl.[5] ..... B67D 5/60

[52] U.S. Cl. ..... 222/144; 141/104; 222/144.5; 222/135; 222/14

[58] Field of Search ..... 222/14, 16, 144, 144.5, 222/129, 135; 141/100, 104, 284

[56] References Cited

U.S. PATENT DOCUMENTS

| | | | |
|---|---|---|---|
| 2,374,430 | 4/1945 | Hexter | 222/144 X |
| 2,787,402 | 4/1957 | Stiner et al. | 222/144.5 X |
| 2,848,019 | 8/1958 | Corbin et al. | 141/100 |
| 2,975,939 | 3/1961 | Russell et al. | 222/144 X |
| 3,015,415 | 1/1962 | Marsh et al. | 222/144 X |
| 3,066,830 | 12/1962 | Heiss et al. | 222/144 X |
| 3,074,597 | 1/1963 | Felts | 222/144 X |
| 3,122,272 | 2/1964 | Marsh | 222/144 X |
| 4,027,785 | 6/1977 | Edstrom et al. | 222/135 |
| 4,637,527 | 1/1987 | Arrigoni | 222/144 |
| 4,681,741 | 7/1987 | Hanaway | 222/144 |
| 4,705,083 | 11/1987 | Rossetti | 141/104 |
| 4,813,785 | 3/1989 | Miller | 74/15.2 X |

*Primary Examiner*—Kevin P. Shaver

*Attorney, Agent, or Firm*—Fitch, Even, Tabin & Flannery

[57] ABSTRACT

Apparatus for coloring paint base material comprises a plurality of container assemblies mounted for indexing movement along a path of travel. A dispensing station is provided adjacent the path of travel. The container assemblies include metering apparatus to discharge preselected amounts of colorant into a container of paint base material. Valves on the container assemblies block the discharge of colorant material from the metering apparatus. Meter actuating and valve actuating apparatus is provided at the dispensing station for automatically dispensing metered colorants into passing containers of paint base material, according to formulae stored in the apparatus.

32 Claims, 5 Drawing Sheets

292
296
300
274
294
252
260
264
290
291
266
292
258
256
294
264
272
250
262
280
262
282
268
276
270
254
260
84
156
164
209
166
166
176
182
180
174
194
160
210
76
178
230
130
174
186
184
200
162
170
174
188
144
82
168
206

PAINT DISPENSING APPARATUS

BACKGROUND OF THE INVENTION

1. Field of the Invention

This invention relates to apparatus for dispensing paint colorant selectively from a plurality of cannisters and, more particularly, to such apparatus having a secondary valve located at the exit of the apparatus and downstream of a primary valve.

2. Description of Related Art

To avoid having to separately inventory different color paints, many paint retailers use a common paint base that is manually tinted with a colorant on a per-order basis. It is known to provide a turntable supporting a plurality of containers holding colorant which is stored therein in liquid form. Metering structure is provided to dispense measured amounts of colorant from the containers into the paint base.

To maintain uniformity from one paint batch to the next, it is essential that the colorant in each container be thoroughly mixed. To accomplish this, rotary agitators are provided to periodically mix the colorant. U.S. Pat. Nos. 4,813,785 provided significant improvements in agitation arrangements for colorant dispensers, such as those disclosed in U. S. Pat. 4,027,785.

SUMMARY OF THE INVENTION

Despite the ready acceptance of the above-mentioned colorant dispensers, certain improvements can be made. For example, a merchandiser of paint materials may find it convenient to limit the major portion of paint inventory to a paint base material, which can be tinted or otherwise colored to produce a wide variety of colored paint materials. Thus, a merchandiser need not estimate beforehand the quantity of a given color paint that should be maintained in stock. While the above-mentioned colorant dispensing apparatus can be relied upon to accurately meter even small amounts of colorants required for a given paint formulation, the number of paint formulations that the public has come to expect has been increasing at a significant rate. In addition, a merchandiser of paint materials frequently carries a number of different paint product lines, each of which includes a full range of colors and tints.

Accordingly, the amount of paint formulation information that a merchandiser must carry and must have readily accessible to provide a particular quantity of colored paint on demand, is increasing at a significant rate. Various attempts have been made to manage a growing amount of paint formulation information. For example, paint colorant machines have been provided with computers for controlling the tinting operation. The paint formulations have been provided via sets of multiple integrated circuit (IC) chips, with one set required for each machine in use. Thus, when the formulations are changed, a merchandiser must remove the several integrated circuit chips of the set from within the computer, and replace those chips with a substitute set, taking care that the individual chips are installed in the proper socket within the computer, and with the proper orientation for that socket. Such systems have proved difficult to work with.

Accordingly, it is an object of the present invention to provide a paint colorant and dispensing machine suitable for fully automatic operation such as that controlled by a microcomputer programmed with the formulations associated with a particular paint base material.

Another object according to the present invention, is to provide a paint colorant and dispensing apparatus suitable for semi-automatic or fully automatic operation, but which is compact in size, and which can be easily serviced.

A further object according to the present invention is to provide an automatic paint colorant and dispensing apparatus of the above-described type which requires a minimum number of specially fabricated components.

These and other objects according to the present invention, which will become apparent from the studying the appended description and accompanying drawings, are provided in an apparatus for coloring paint base material, comprising:

a plurality of container assemblies for carrying paint colorant materials;

a dispensing station, adjacent a path of travel of said container assemblies, whereat colorant materials carried by said container assemblies are dispensed into the paint base material;

said container assemblies including metering means associated with each container, actuable to receive a preselected amount of colorant material from the container and to discharge said preselected amount into the paint base material;

said container assemblies further including valve means associated with each metering means, actuable to block the discharge of colorant material from said metering means into said paint base material;

conveyor means for mounting said container assemblies for movement along said path of travel;

meter actuating means engageable with the metering means of said plurality of container assemblies to actuate said metering means so as to receive a preselectedly metered quantity of colorant material from the associated container assembly and to discharge said colorant material into the paint base material;

valve actuating means engageable with the valve means of said plurality of container assemblies to actuate said valve means so as to open and close said valve means to selectively permit discharge of said colorant into the paint base material; and indexing means for indexing said conveyor means so as to present a preselected container assembly to said dispensing station.

BRIEF DESCRIPTION OF THE DRAWINGS

In the drawings, wherein like element are referenced alike.

DETAILED DESCRIPTION OF THE PREFERRED EMBODIMENTS

Figure 1:
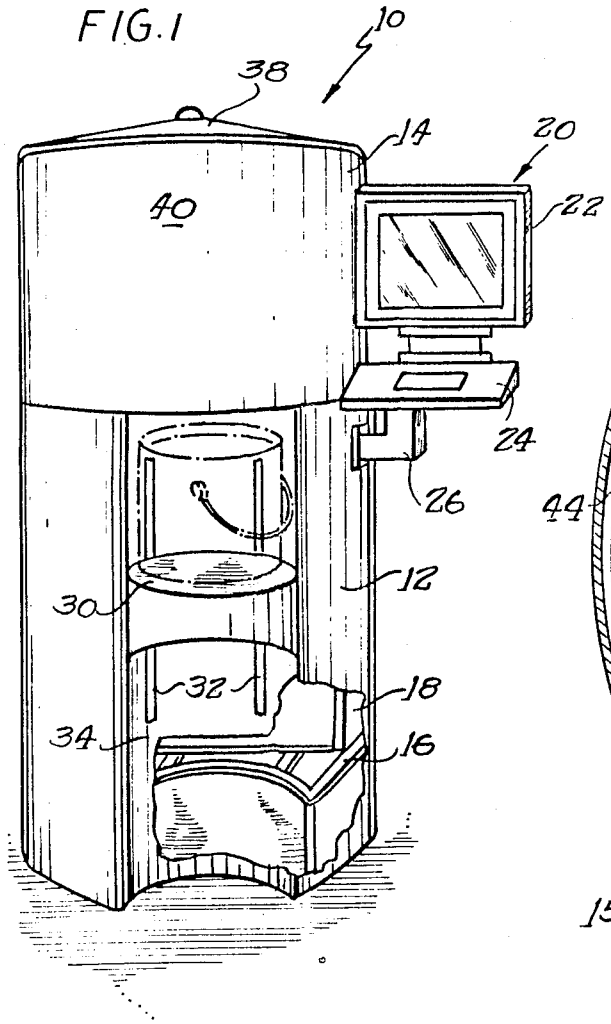
FIG. 1 is a perspective view of a paint colorant and dispensing apparatus illustrating aspects according to the present invention.

Referring now to the drawings and initially to FIG. 1, a paint colorant and dispensing apparatus is generally indicated at 10. The apparatus 10 includes a lower housing 12 and an upper housing 14 mounted thereon. As can be seen in the lower corner thereof, which is shown partially broken away, housing 12 includes a shelf 16 on which a computer 18 or other digital control apparatus is mounted. The computer 18 is coupled to a terminal generally indicated at 20 which includes a cathode ray tube (CRT) display 22 and a keyboard 24 which are mounted by a support arm 26 to housing 12.

Figure 2:
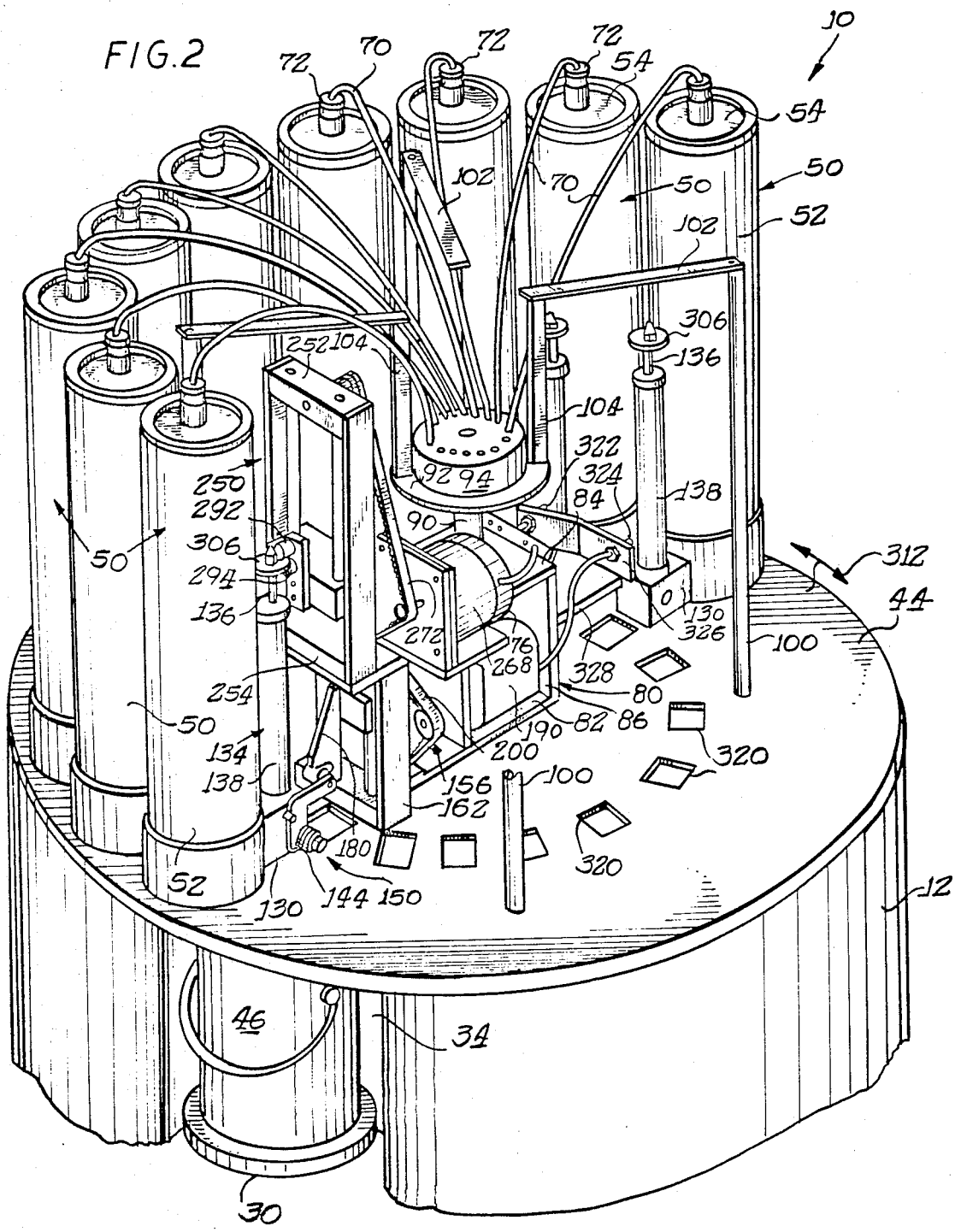
FIG. 2 is a fragmentary perspective view of the apparatus of FIG. 1, shown with the outer cover removed.

Apparatus 10 further includes an elevator or moveable platform 30 which is slidable in upward and downward directions along tracks 32. The tracks are preferably formed in a hollow recess 34 of housing 12 which is sized to accommodate a substantial portion of a paint bucket 46 as shown in FIG. 2 and as has been inserted indicated in phantom in FIG. 1. Owing to the recess 34, the upper housing 14 protrudes outwardly, above a central portion of the paint bucket. As will be seen herein, paint colorant is selected, metered, and dispensed within housing 14 so as to drop into the open, upper end of the paint bucket.

Figure 3:
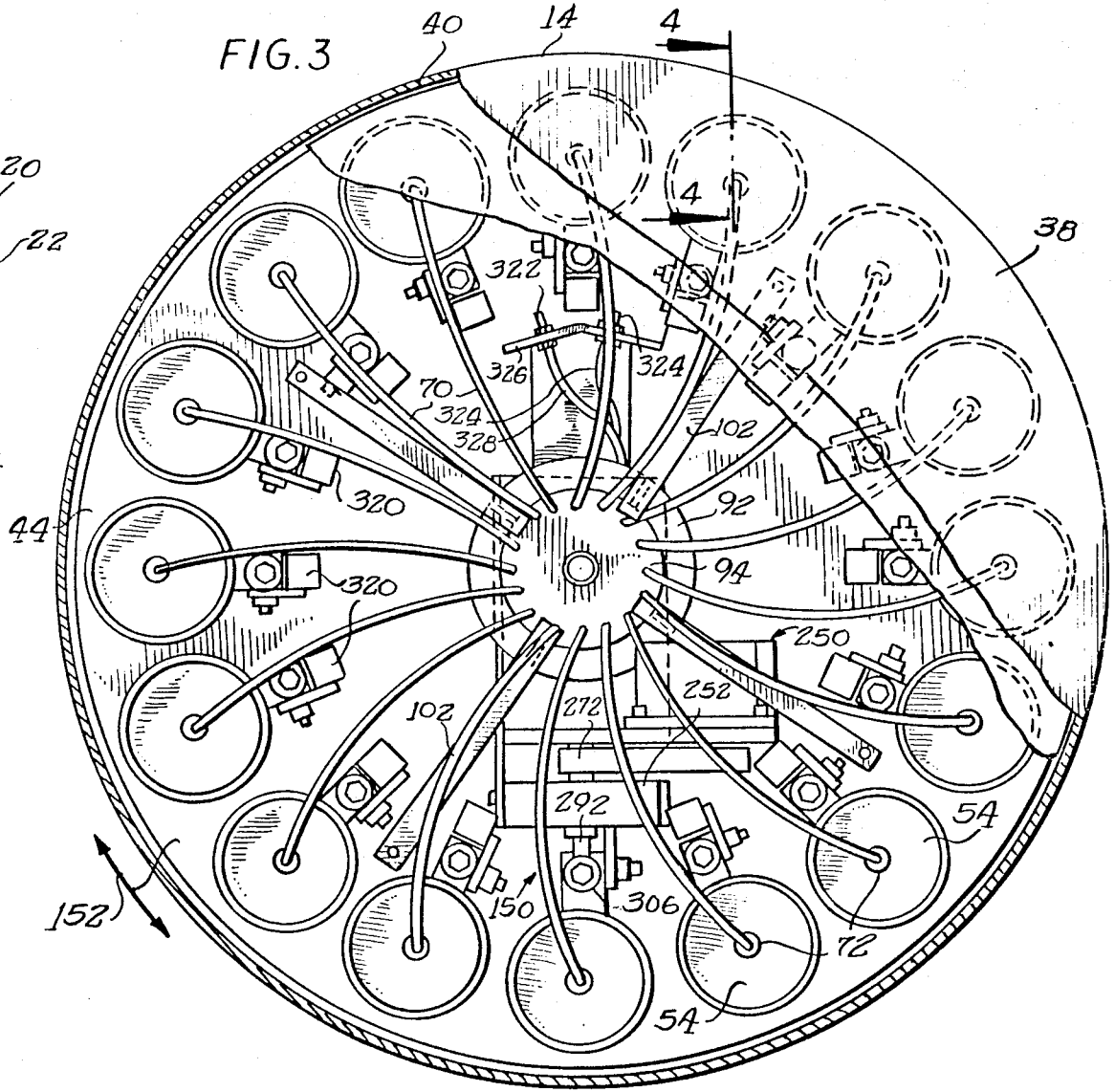
FIG. 3 is a top plan view of the apparatus of FIG. 1, shown with the cover thereof partially broken away.

With additional reference to FIGS. 1 and 3, the upper end of housing 14 is enclosed by a lid or cover 38. Housing 14 further includes an outer, generally cylindrical sidewall 40, preferably made of sheet metal or the like rigid material. FIG. 2 shows the upper portion of the paint colorant and dispensing apparatus 10, with the outer wall 40 and the upper cover 38 removed therefrom to show various internal components of apparatus 10 which are mounted atop a rotating turntable 44. The turntable is rotatably supported at its central portion, as will be seen below with reference to FIG. 5.

As mentioned above, the housing 14 overlies recess 34, which a variety of different sized paint buckets or other containers holding a paint base material. For example, the paint bucket 46 illustrated in FIG. 2 could be dimensioned to store one gallon of paint base material. Given the relative proportions illustrated in the figures, the same apparatus 10 could also readily accommodate conventional paint base containers of one pint, one quart, and five gallon size. As will be seen herein, the apparatus can be adapted to readily store paint formulations for a number of different sized containers and could, for example, perform simple proportional calculations on a single paint formula so as to derive the command signals necessary to dispense proper amounts of a colorant for a given size container of paint base material.

Referring again to FIG. 2, the paint colorant and dispensing apparatus 10 includes a plurality of colorant container assemblies 50 disposed about turntable 44. According to one aspect of the present invention, the colorant containers are disposed about the outer periphery of turntable 44 so as to be moveable over recess 34, upon rotation of the turntable. In the preferred embodiment, 16 colorant containers are provided for the apparatus 10, although the apparatus could be readily adapted to accommodate a different number of containers, if desired.

Figure 4:
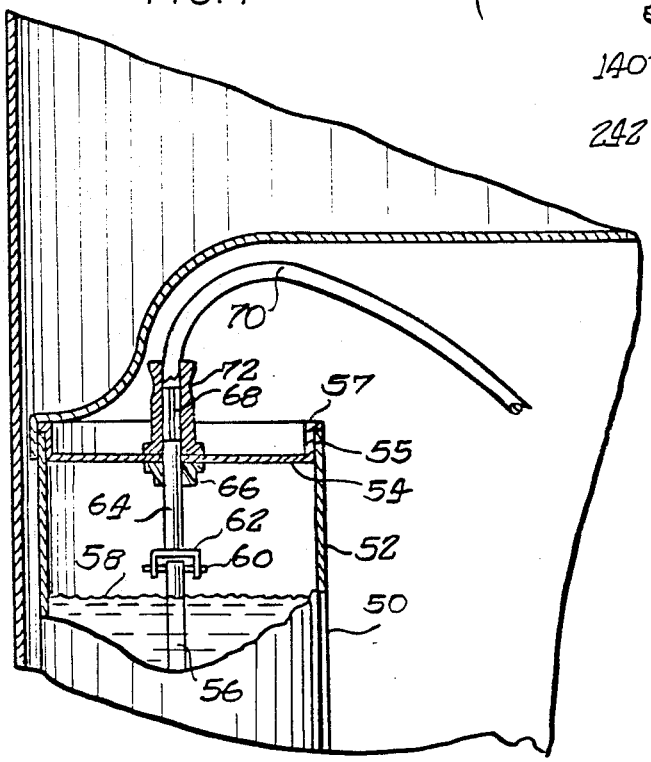
FIG. 4 is a fragmentary cross-sectional view taken along the line 4—4 of FIG. 3.

The paint colorant container assemblies 50 include a generally cylindrical container 52 having an upper, open end enclosed by a lid 54. Disposed within each container is an agitator 56 (see FIG. 4) immersed within the colorant liquid 58. The upper end of agitator 56 includes a lateral pin member 60 received in a U-shaped stirrup 62. The stirrup is slotted at its free end to receive the pin 60 and to engage the pin for rotating the agitator about its longitudinal axis. A stub shaft 64 is journalled for rotation in a sleeve 66 carried on the container cover 54. The stub shaft 64 may have a hollow center for keyed engagement with a shaft 68 of a flexible drive cable 70. The drive cable 70 is terminated at a sleeve 72 which maintains the free end of cable 70 in a generally vertical orientation at its point of connection to the colorant container assembly 50. Various arrangements may be provided for the keyed interconnection between the shaft of flexible cable 70 and the stirrup connector 62. Further details concerning the construction of the keyed interconnection may be found in the aforementioned U.S. Pat. No. 4,813,785 which is herein incorporated by reference.

Referring again to FIG. 2, an agitator drive motor 76 is located at the center of turntable 44. An internal framework structure generally indicated at 80 is also located at the center of turntable 44 and, as will be seen, provides a number of advantages. The agitator drive motor is preferably disposed within the internal framework structure 80 and, although such cannot be seen in the figures, the output shaft of the agitator drive motor extends in an upright, generally vertical direction. The internal framework structure 80 includes a lower base member 82 which, as will be seen, is fixed in a stationary position, and does not rotate with turntable 44. Structure 80 also includes an upper plate member 84 and a backing member 86. An upright support column 90 extends from the upper plate 84. The support column has a hollow center which receives the output shaft of agitator drive motor 76./ A generally circular support plate 92 is mounted atop/the support column 90 and supports a gear train mechanism 94 which is coupled to the output shaft of the agitator drive motor 76. The gear train mechanism 94 has a plurality of rotatably driven outputs at its upper end, with each output coupled to rotatably drive a flexible drive cable 70. In the preferred embodiment, gear train mechanism 94 has 16 outputs, each associated with a respective colorant container. Further details concerning the gear train mechanism and the rotatable driving of the agitators in each colorant container may be found in the aforementioned U.S. Pat. No. 4,813,785.

Referring again to FIG. 4, the covers 54 include an upstanding peripheral rim 55 and an outer lip 57 which form a plug fit with the container 52. The plug fit provides a simple and reliable joinder between the covers and cylindrical vessels but, if desired, other, conventional means may be used to releasably join the two.

Referring again to FIG. 2, a number of framework supports 98 are disposed about turntable 44. The framework supports include upright posts 100 and generally radially extending horizontal members 102 which are supported at their inner free ends by inner upright members 104 extending from the support base 92. The horizontal members 102 of the framework supports protect the various moving mechanisms of apparatus 10, as when the cover 38 is moved to replenish the supply of colorant in container assemblies 50.

Figure 5:
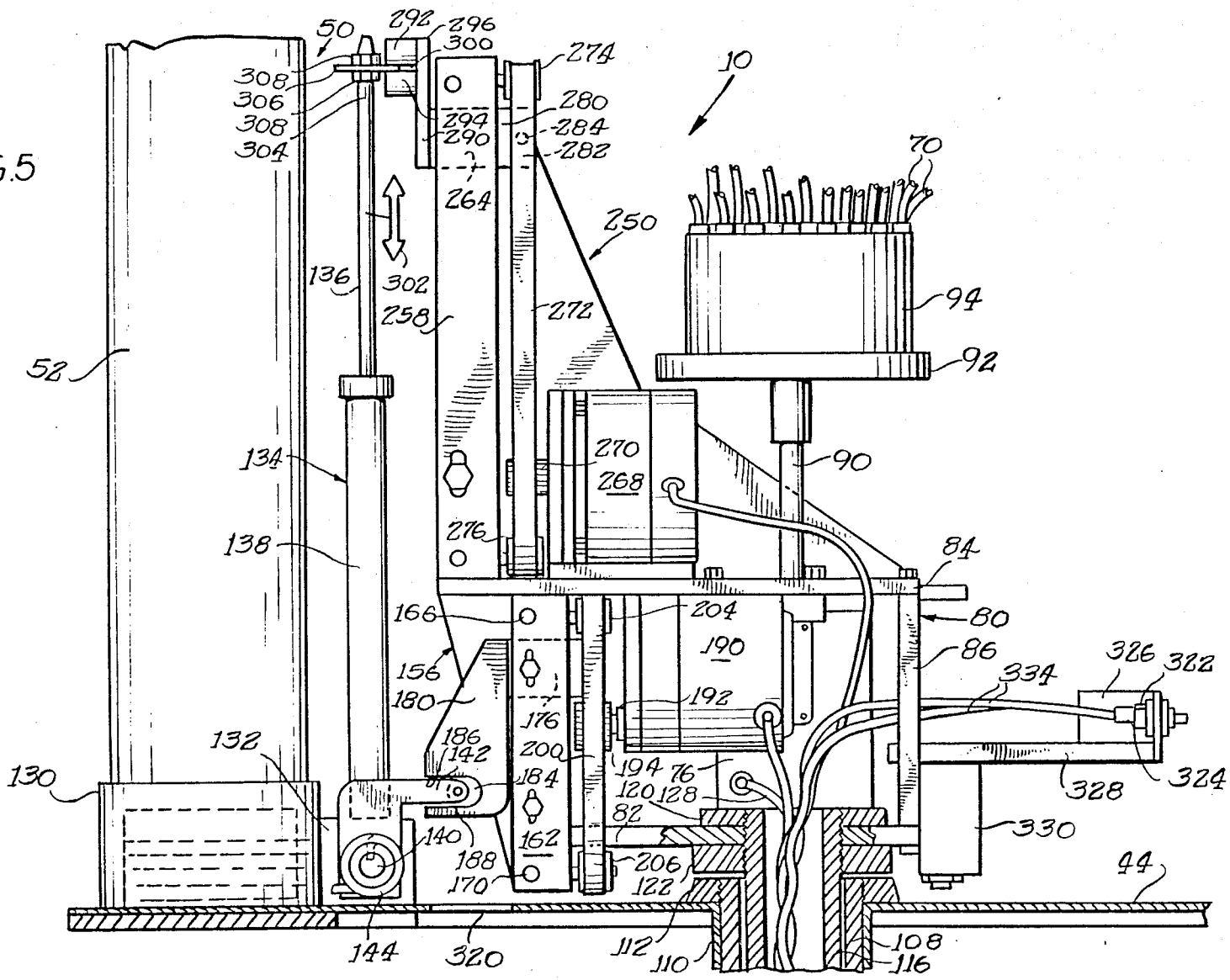
FIG. 5 is a fragmentary side elevational view of the apparatus of the preceding figures, shown partly in cross-section.

As mentioned above, the containers 50 are preferably mounted along an annular path adjacent the outer periphery of turntable 44. Turning now to FIG. 5, turntable 44 is mounted atop a rotating support column 108 which is rotatably driven by conventional mechanism located in lower housing 12. The turntable 44 includes a central, downwardly depending collar 110 telescoped over and affixed to the outer surface of support column 108. A ring 112 attached to the upper end of support column 108 clamps turntable 44 in position, and provides a stabilizing thereof against tilting or wobbling. Other, conventional means for attaching turntable 44 to a rotating support shaft may also be used.

A stationary support shaft 116 is concentric with and disposed within the rotating support shaft 108. Upper and lower rings 120, 122 are attached to the upper end of stationary support column 116. The lower base member 82 of the internal framework structure 80 is clamped between the support rings 120, 122 and, additionally, may be attached directly to the stationary support column 116 Alternatively, the lower base member could be attached to the stationary support column with any suitable conventional means such as welding. As can be seen in FIG. 5, the stationary support column 116 has a hollow passageway formed by its internal bore 126, suitable for housing electrical leads such as the electrical lead 128 for energizing the agitation drive motor 76.

Returning again to FIG. 5, a colorant container assembly 50 is illustrated as having the aforementioned container 52 for storing a quantity of liquid coloring material. The container 52 is mounted at its lower end to a valve 130 which includes a valve housing 132 located at the base of container 52. The valve housing 132 includes a passageway communicating with the interior of the container 52 to permit flow of a colorant material to a pump generally indicated at 134. The pump is attached at its lower end to valve housing 132 and defines a pumping chamber in which a piston reciprocates. A pump rod 136 extends above the pumping chamber and is secured to a piston, not shown in the figures, disposed within the pumping chamber.

As the rod is raised, a suction is applied by the piston to withdraw colorant material from container 52, through passageways within base 132. A valve located in the base blocks the outflow from container 50, as well as the discharge of material from the pumping chamber. A shaft 140 is attached to the valve and when rotated, opens and closes the valve. A crank arm 142 is attached to one end of shaft 140 and a spring 144 biases the shaft for rotation in a direction which closes the valve. With continuous rotation of the valve in a given direction, a first portion of the valve opens to permit flow from the storage container 52 to the pumping chamber, while blocking the outlet of the pumping chamber. Upon further rotation, the container 52 is blocked, and a second portion of the valve is opened to permit a discharge of colorant material into a bucket of paint base material disposed beneath the turntable 44.

According to one aspect of the present invention, the pump 134 and the valve within valve housing 132 cooperate to provide precisely metered quantities of colorant material, the quantities being directly proportional to the stroke of piston rod 136. Further details concerning the construction and operation of the valve housing 132, the pump 134 and the internal valve are provided in U.S. Pat. No. 4,027,785 which is herein incorporated by reference.

As can now be seen, the dispensing of a metered quantity of colorant material is provided by the sequential operation of the crank arm 142 and the piston rod 136 in the manner described in the aforementioned U.S. Pat. No. 4,027,785. The present invention, in some of its aspects, provides an automated operation of that crank arm and pump rod, in cooperation with an indexing of table 44 to present a prescribed series of metered quantities of colorant materials at a workstation located above the paint base material. With reference to FIG. 3, a dispensing station generally indicated at 150 is located at a point on the periphery of turntable 44. As will be seen herein, the workstation includes a number of components which are mounted to or otherwise associated with the internal framework structure 80, so as to be located at a fixed stationary position. As the turntable 44 is rotated in opposing directions of arrow 152, a series of colorant containers are presented to workstation 150.

Figure 6:
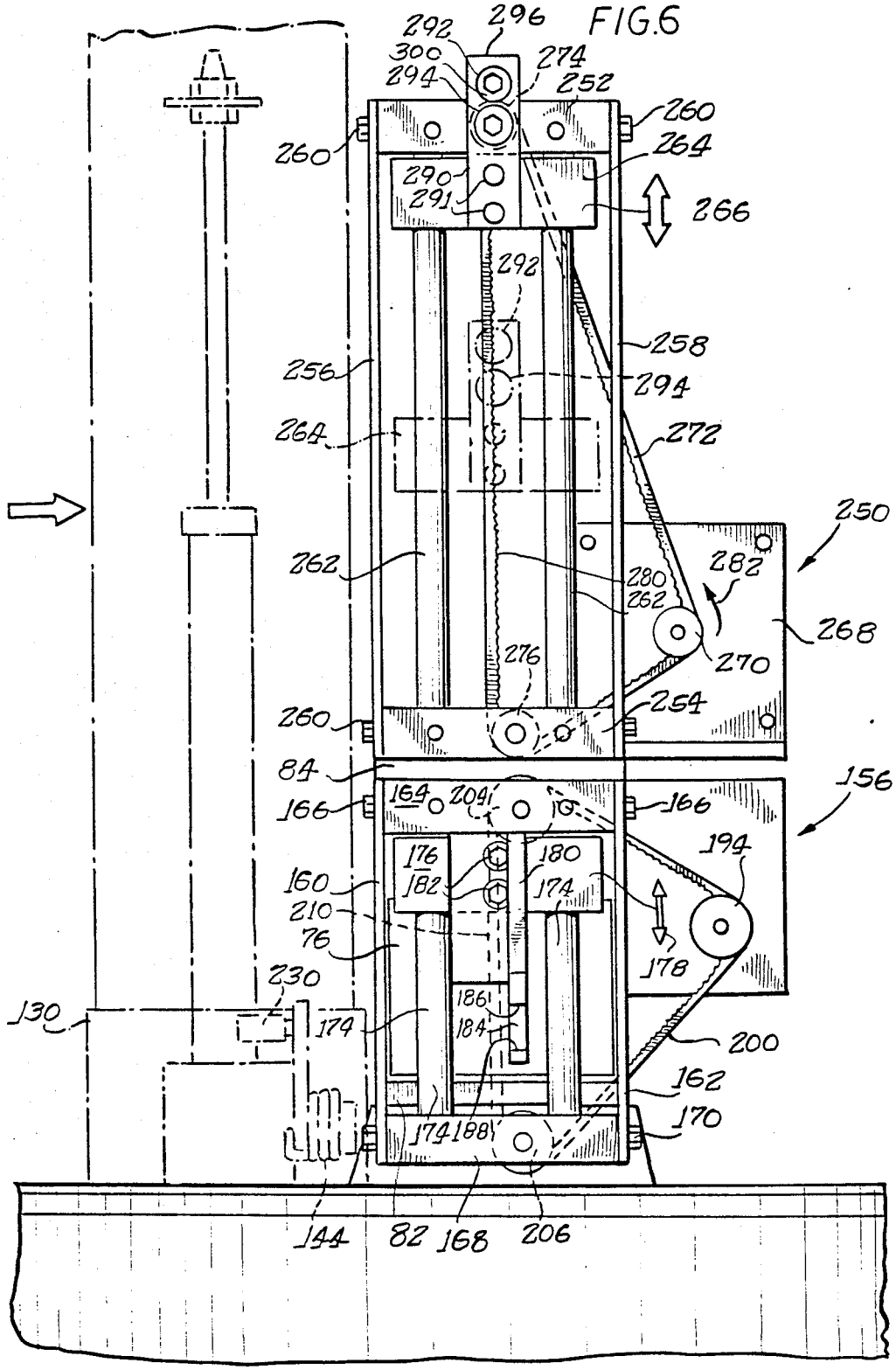
FIG. 6 is a fragmentary front elevational view of the apparatus of the preceding figures.

Referring now to FIG. 2, and especially to FIGS. 5 and 6, a container operating means is located at workstation 150, adjacent the path of travel of colorant containers carried on turntable 44, for delivering metered amounts of colorant materials in the various containers to a container of paint base material, such as the aforementioned bucket 46, located beneath turntable 44. As will be seen, the container operating means an arrangement for actuating the metering pump 134, and a mechanism for actuating the valve internal to valve housing 132 which can be readily automated to cooperate with indexing of turntable 44 carried out under instructions from a digital control unit such as the aforementioned digital computer 18.

Turning now to FIGS. 5 and 6, and referring initially to the lower portions thereof, a valve actuating mechanism is generally indicated at 156. The mechanism is supported by the aforementioned internal framework structure 80 and with reference to FIGS. 5 and 6, includes sidewalls 160, 162, the upper ends of which are attached to the upper plate 84. A header block 164 is attached by bolt fasteners 166 to the upper ends of sidewalls 160, 162. A footer or lower support 168 is secured to the lower ends of sidewalls 160, 162 by bolt fasteners 170. A pair of generally cylindrical guide rails 174 have their opposed ends mounted in the header and footer members 164, 168. A travelling head 166 is reciprocally mounted on guide rails 174 for travel in the vertical directions indicated by arrow 178. A bracket 180 is secured at its upper end to travelling head 176 by bolt fasteners 182. The bracket 180 has an outwardly opening recess 184 formed therein by a pair of opposed upper and lower edges 186, 188.

A valve actuating motor 190 is mounted to the internal framework structure 80 and is oriented so that output shaft 192 thereof extends in an forward, generally horizontal direction. A drive gear 194 is mounted to motor shaft 192 and has an outer toothed surface for engagement with a cog belt 200. With brief reference to FIG. 6, the cog belt 200 follows a generally triangular-shaped path, with one leg of the triangular path extending in a generally vertical direction. Belt 200 is wound about a pair of idler rollers 204, 206, in addition to the drive gear 194. The upper idler roller 204 is mounted to the header block 176 and the lower idler roller 206 is mounted to the footer block 168. The idler rollers 204, 206 are located one above the other so that the portion 210 of belt 200, spanning the distance between the idler rollers 204, 206, extends in a generally vertical direction.

Figure 7:
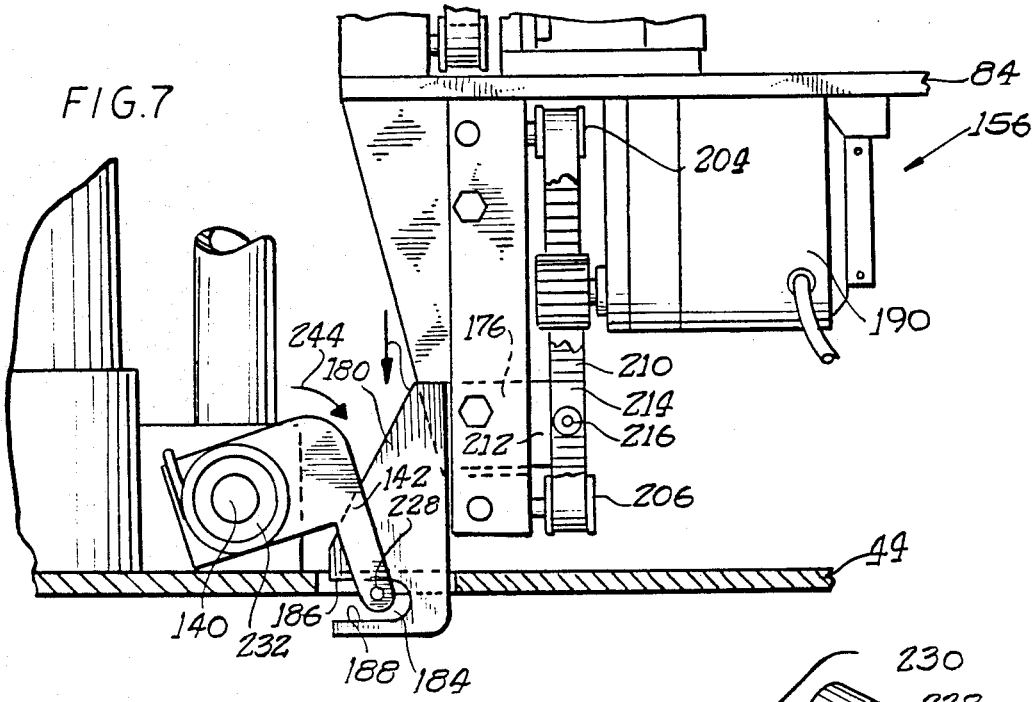
FIG. 7 is a fragmentary side elevational view, taken on an enlarged scale, showing the lower portion of FIG. 5 in greater detail.

Referring now to FIG. 7, the valve actuating mechanism 156 is illustrated on an enlarged scale, and the portions of drive belt 200 between the drive gear 194 and the idler rollers 204, 206 has been removed to show a bracket 212 rearwardly extending from travelling head 176. The vertical segment 210 of drive belt 200 is clamped between bracket 212 and a clamping piece 214, which are secured together by a threaded fastener 216. In the preferred embodiment, valve actuating motor 156 is a D.C. motor, which is rotatable in opposing directions so as to be able to move the segment 210 of drive belt 200 in upward and downward vertical directions. Accordingly, the bracket 212, the travelling head 176 and the slotted bracket 180 attached thereto can be displaced in precise amounts in vertically upward and downward directions. FIG. 5 shows the crank arm 142 in a raised position, which closes the valve in valve housing 132. When opening of the valve is desired, motor 190 is energized so as to move the belt portion 210 in a downward direction, thereby lowering the slotted bracket 180, and thus the crank arm 142, to the position indicated in FIG. 7, whereby the valve within valve housing 132 is moved to an open position for dispensing of colorant material.

Figure 8:
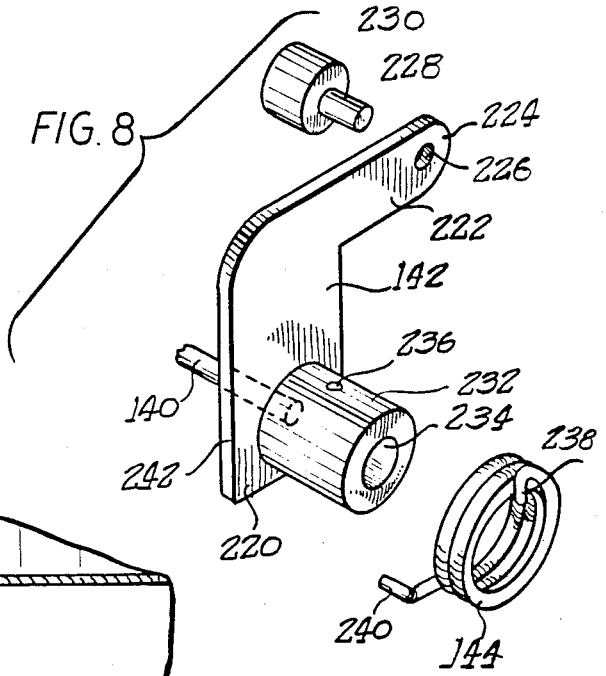
FIG. 8 is an exploded perspective view of the valve assembly portion of FIG. 7.

Referring now to FIG. 8, the crank arm 142 can be seen to have a generally L-shaped configuration with a first leg 220 overlying the axis of valve shaft 140, and a second leg 222 which, when the valve is in a closed position, extends in a horizontal, radially disposed with respect to the turntable. The second leg 222 has a rounded free end 224 in which an aperture 226 is formed to receive the shaft 228 of a roller 230. A collar 232 extends from the crank arm 142 and has an inner bore 234 for receiving the valve shaft 140. An aperture 236 is formed in the collar to receive a hook-shaped free end 238 of spring 144, so that, when installed, the spring 144 surrounds the collar 232 and is generally concentric therewith. The second end 240 of spring 144 engages an edge 242 of crank arm leg 220. The collar 232 is moveable with respect to crank arm 142, and the leg 220 of the crank arm has a keyed aperture for receiving the valve shaft 140 for keyed engagement therewith. Thus, as the crank arm 142 is rotated in the clockwise direction of arrow 244 of FIG. 7, the coils of spring 144 are tightened, storing a bias force for returning the crank arm to the closed valve position illustrated in FIG. 5. With reference to FIG. 2, a series of generally rectangular openings 320 are formed in turntable 44, with one opening adjacent each container assembly. The openings 320 allow clearance for the crank arm legs 222 as the slotted bracket 180 is lowered to rotate the valve shaft 140 in the clockwise direction of arrow 244.

It should be noted from the above that, when the valve is in a closed position, the crank arm leg 222, which protrudes toward the valve actuator mechanism 156 is aligned to pass through the outwardly opening recess 184 of slotted bracket 180. When a container assembly and its associated crank arm are located at the dispensing station 150, the crank arm leg 222 is received in the slotted recess 184 of the angle bracket.

According to another feature of the present invention, the protruding legs 222 of the crank arms associated with the several colorant container assemblies 50 are aligned to pass through the same recess 184 of angle bracket 180 such that the protruding crank arm legs are free to travel past the angle bracket 180, thus avoiding any contact or other interference between the rotating and stationary portions of the colorant and dispensing apparatus 10. Although the angle bracket 180 could be mounted for pivoting movement or perhaps radially inward translational movement away from the path of travel of the protruding crank arms 222, such is generally not preferred, as the complexity and cost of the mechanism is thereby increased and the chances of losing precision in operation of the angle bracket are increased.

Although, as has been seen above, the angle bracket 180 is moveable in vertical directions, it is preferred that the angle bracket be fixed with respect to movement in other directions, thus simplifying the design of the angle bracket and the associated mechanism for actuating that bracket, while reducing the risk of inaccuracies when repetitively operating the crank arms of the several colorant containers. As mentioned above, the valve construction and operation follow the principles disclosed in U.S. Pat. No. 4,027,785. Accordingly, due to the multiple porting of the valve shaft and the close tolerance angular displacement of that porting, the valve actuating mechanism must be capable of fairly accurate rotational displacement of the valve shaft to insure proper operation of the dispensing valve. The various features of the valve actuating mechanism 156 achieve these benefits.

As will be seen below, these same principles of limited movement of the pump actuating mechanism along a highly accurate repeatable path of actuation, coupled with an ability to clear the interengaging projections of rotating container assemblies are also found in the metering apparatus which presents, perhaps, an even stronger need for actuating mechanisms capable of a highly accurate and repeatable movement. The present invention achieves these objectives in a colorant dispensing and metering apparatus which is compact and which can be simply and economically formed from a minimum number of relatively inexpensive parts.

Referring again to FIGS. 2, 5 and 6, a mechanism for actuating the metering pumps of the various colorant containers is generally indicated at 250. As will be seen, the pump actuator mechanism 250 has certain similarities to the valve actuating mechanism 156 described above. For example, header and footer blocks 252, 254 are secured to sidewalls 256, 258 by suitable means, such as threaded fasteners 260. Generally cylindrical guide rails 262 are secured at their opposed ends to the header and footer blocks 252, 254. A travelling head 264 is mounted on guide rails 262 for reciprocation in vertical directions, indicated by the double headed arrow 266.

A pump drive motor 268 is attached to upper plate 84 and is oriented to have a generally horizontal, forwardly extending output shaft. A drive gear 270 is secured to the motor output shaft for rotation therewith, and has teeth on its outer surface for meshing with a cog belt 272. With reference to FIG. 6, the cog belt 272 has a generally triangular or three-sided configuration, being supported at one corner by the aforementioned drive gear 270, and being supported at the remaining corners by upper and lower idler rollers 274, 276. The upper and lower drive rollers 274, 276 are disposed one above the other so that the section 280 of cog belt 272 suspended therebetween extends in a generally vertical direction. Drive motor 268 is preferably of the step motor type, being capable of controlled operation in opposing directions of rotation. Thus, in operation, the drive motor 268 can be stepped in response to electrical control signals to move the vertical section 280 of cog belt 272 in defined vertical increments.

Referring again to FIG. 5, a bracket 280 extends rearwardly from travelling head 264 and is positioned to contact a surface of cog belt section 280. A clamping member 282 is placed over an opposing surface of cog belt 272 and is secured to bracket 280 with a suitable fastener 284. Thus, the travelling head 264 is clamped to the cog belt section 280 for travel therewith in reciprocating vertical directions. Referring to FIGS. 5 and 6, the travelling head 264 is illustrated in its uppermost position. With reference to FIG. 6, rotation of the output shaft of motor 268 in the counterclockwise direction of arrow 282 will cause the cog belt section 280, and the travelling head 264 secured thereto, to travel in a downward direction, to a lowered position, such as that illustrated in phantom in FIG. 6.

An upstanding bracket 290 is secured to the forward portion of travelling head 264 by suitable means such as threaded fasteners 291. Upper and lower rollers 292, 294 are secured to the upper portion 296 of bracket 290. The rollers 292, 294 preferably have mounting shafts similar to the mounting shaft 228 of roller 230, described above with reference to FIG. 8. The rollers 292, 294 are mounted for rotation about generally horizontal, radially extending axes. In the preferred embodiment, the axes of rotation of the rollers 292, 294 are disposed one above the other. As indicated in FIG. 5, the rollers 292, 294 are preferably spaced apart a small distance so as to form an opening 300.

The metering pump 134 includes a shaft 136 mounted to a piston disposed within a cylindrical pump housing 138. The lower end of pump housing 138 is joined to valve housing 132 and the valve 130 is operable to block the discharge from the pump, and to also control its intake of liquid colorant material from the container 52.

Referring again to FIG. 5, the pump 134 has a piston-connected shaft or rod 136 which is moveable in vertical directions indicated by the double-headed arrow 302. The upper, free end 304 of rod 136 receives a washer 306 which is secured thereto by threaded fasteners 308. In the preferred embodiment, the washer 306 is oriented generally perpendicular to the vertical axis of rod 136 so as to present a minimum profile to the opening 300 between rollers 292, 294. As turntable 44 is rotated in the opposing directions indicated by double-headed arrow 152, the washers 306 associated with the colorant container assemblies 50 are moved past the dispensing station 150, being passed through the opening 300 formed between rollers 292, 294.

In the preferred operation of the colorant and dispensing apparatus 10, the travelling head 264 of the pump actuating mechanism 250 is in the lowered position indicated in FIG. 2 and the pump rods 136 of the colorant container assembly 50 are in the indicated lower or retracted position aligned with the opening 300 between rollers 292, 294. As will now be appreciated, as the washers 306 of various colorant container assemblies are passed between rollers 292, 294, the washer and rollers present curved, generally circular surfaces to one another which reduces the risk of binding as the initial areas of nipping engagement are very small, and are gradually increased at a steady rate. As with the slotted bracket for the valve actuating mechanism, the space between rollers 292, 294 is part of a continuous opening which lies in a horizontal plane passing through opening 300 thus allowing free, unobstructed passage of the protruding washers carried on the plurality of colorant container assemblies.

The operation of the pump actuating mechanism 250 has many of the same advantages as described above with reference to the valve actuating mechanism 156. For example, the pump actuating mechanism has a protrusion receiving recess 300 for the washers 306 which is fixed, being defined by a pair of fixedly spaced-apart guide surfaces, herein the outer surfaces of rollers 292, 294. Further, the guide rollers 292, 294 are constrained for movement in vertical directions. If desired, the bracket 290 carrying the rollers 292, 294 could be mounted for rotation or radially inward translation away from the path of passing washers 306, but such is generally not preferred.

Accordingly, it is required that the washers of colorant container assemblies passing through the dispensing station be received in an opening 300 between the rollers 292, 294, the locations of which are fixed in space. Additional advantages are provided by the rollers 292, 294 in that the rollers are mounted for rotation about their central axes, corresponding to the direction of forces imparted thereto by moving washers 306, should contact therebetween be experienced. Further, in the unlikely event that a washer 306 of a particular colorant container assembly should become slightly displaced during operation of apparatus 10, or during a servicing procedure, for example, the rollers 292, 294 with a minimum of disturbance, will guide the washer 306 to a very accurately defined height above turntable 44.

Certain variations to the pump actuating mechanism can be made. For example, one or both of the rollers 292, 294 can be spring-loaded so as to be moveable away from the opening 300, but with an increasing bias force tending to restore the preselected spacing described above. Also, the washers 306 of the colorant container assemblies can be mounted for rotation about their central, vertically aligned central axes, thereby further reducing any frictional engagement or disturbing force caused by contact with the rollers 292, 294. As can be seen from the above, the rod 136 of the metering pumps need only present a protruding member extending toward opening 300 so as to be captivated or nipped between rollers 292, 294. Accordingly, the washer 306 could be replaced by a flat plate of non-circular configuration. However, the annular configuration of washers 300 is preferred in that the amount of protrusion thereof from the central axes of rod 136 is maintained constant, despite the application of any forces that may be experienced by the washer during operation of apparatus 10.

As can be seen from the above, the valve actuating mechanism 156 and the pump actuating mechanism 250 can be readily adapted for use with digital and other electronic control systems. One advantage of a colorant metering and dispensing apparatus constructed according to principles of the present invention, is that the actuating mechanisms can be economically constructed from a minimum number of inexpensive parts, thereby avoiding the higher costs of construction and maintenance commonly associated with automated mechanisms which must repeatedly operate with accurate, well defined movements.

In the preferred embodiment of the colorant metering and dispensing apparatus, a programmable computer 18 is provided in lower housing 12 for the fully automatic operation of apparatus 10. However, if desired, the actuating mechanisms and related features of the colorant metering and dispensing apparatus can be fully automated under the control of electrical systems which are not necessarily of a programmable nature. For example, the programmable computer 18 can be replaced by one or more feedback control circuits, either of the closed loop or open loop type. However, the programmable computer is preferred for automated control of apparatus 10 since, as will be appreciated by those skilled in the art, changes in a family of paint colors often requires numerous adjustments to the various paint formulations associated with that color family. With the programmable computer, families of color formulations can easily be entered through keyboard 24, or through magnetic storage media which can be read into and stored in the electronic memory within computer 18. The CRT monitor 22 provides an easy means of locating a paint formulation stored in the computer for use on demand, as when it is desired to color a given quantity of paint base material to obtain a paint product of a specified color.

In a fully automated paint coloring operation, the turntable 44 is indexed to present a series of selected paint colorant container assemblies to dispensing station 150. Given a particular color family of paint colors, formulations for each color are stored in computer 18. The formulations for particular colors will specify the particular colorant and the amount of such colorant to be dispensed in the container of paint base material. This is accomplished by identifying a particular position on turntable 44 for the colorant container assembly holding the desired liquid colorant material.

The formulation for each selected colorant material will also specify the amount of such material to be dispensed at station 150. Thus, means are provided responsive to indexing signals outputted by computer 18, to rotate turntable 44 a necessary amount to present a particular colorant container assembly to workstation 150. Thereafter, the computer 18 outputs valve actuation signals and metering pump actuation signals which displace the slotted bracket 180 and the upstanding bracket 290 holding rollers 292, 294 prescribed amounts to accomplish the metered dispensing of a colorant from a particular colorant container assembly presented to workstation 150.

More particularly, the meter actuation signals cause the pump motor 268 to displace the travelling head 264 a carefully prescribed amount so as to raise washer 306, and hence the piston within pumping chamber 134, a carefully controlled distance so as to withdraw an accurate amount of liquid colorant material through valve housing 132 into the pumping chamber. Thereafter, the valve actuating motor 190 receives valve actuation control signals from computer 18 which cause the travelling head 176 to descend, thereby rotating valve shaft 140 in desired sequence of steps which first introduces a port between the container 52 and pump housing 134 to permit the withdrawal of colorant material. Upon completion of the metered withdrawal, the valve actuating motor is further rotated to present another port which allows dispensing of the metered colorant temporarily stored in pump housing 134, as travelling head 264 is lowered to its rest position, thereby forcing the metered colorant through valve 130, into a container of paint base material located therebelow.

As illustrated in FIGS. 5 and 7, the slot 184 in bracket 180 is considerably larger than roller 230. As the slotted bracket 180 is lowered, it applies pressure to the crank arm 142 and the engagement with the crank arm comprises a low friction rolling motion. When a dispensing operation has been completed and closure of valve 130 is desired, the direction of rotation of drive motor 190 is reversed so as to raise slotted bracket 180. Due to the spring bias return applied to shaft 140, engagement of roller 230 with the upper slot surface 186 is maintained. Thus, if desired, the lower slot surface 188 and the material of bracket 180 therebelow could be removed. However it is desirable to maintain the lower portion of bracket 180, that portion below slot surface 188, so as to insure a foolproof return of the valve shaft to its closed position. It should be noted in this regard, that with the valve in the fully opened position, as illustrated in FIG. 7, the crank arm leg 222 is inclined at an angle from the vertical so as to prevent any binding that would otherwise interfere with the valve closing, occur.

As mentioned above, a fully automated paint metering and dispensing apparatus requires indexing means for indexing the turntable 44 so as to present one or more preselected colorant container assemblies to the dispensing station 150. As has been seen from the above, the indexing means includes a rotatably driven support shaft 108. The rotating drive for shaft 108 may take any one of a number of conventional forms, and will not be described further. It is important that the rotatable drive be able to determine when a particular colorant container assembly is precisely located at the dispensing station 150. The indexing means should also be capable of tracking the locations of the various colorant container assemblies.

According to one aspect of the present invention, a pair of sensors, preferably optical sensors are provided for collecting data from which the location of the colorant container assemblies can be adduced. The optical sensors are illustrated in FIGS. 2, 3 and 5, and are indicated by reference numerals 322, 324. The sensors are mounted in a V-shaped bracket 326 which is supported at the end of an extension member 328 mounted to receive cantilever support from backwall 86. A support block 330 provides additional support. The sensors 322, 324 may comprise a transmitter/receiver pair, or each sensor may include both transmitting and receiving elements. Electrical leads 334 from the sensors are fed through the inner bore 126 of stationary support post 116, and are coupled at their remote ends to computer 18. The signals from sensors 322, 324 are fed into computer 18 along conductors 334 to provide a feedback signal to the turntable rotation drive which is also controlled by computer 18. Any of a number of conventional control circuit designs can be used to index turntable 44 so as to accurately position a particular colorant container assembly at dispensing station 150.

Operation of the colorant metering and dispensing apparatus is initiated with the entry of a desired paint color and quantity size which is entered into computer 18 via terminal 24. The computer matches the paint name to a formulation stored either in its memory, or on a floppy disk or the like magnetic storage media. The paint formulation specifies the colorants used in the particular formula, and the amount of colorant required, depending upon the container size indicated. According to one aspect of the present invention, the computer looks up the present location of the turntable, which has been previously indicated by the sensors 322, 324. The computer then calculates the closest container assembly called for in the formula, and the direction of rotation required to bring that colorant assembly to the dispensing station in the shortest possible time. As the container assembly approaches the dispensing station, the roller 230 associated with the container assembly valve, and the washer 306 also associated with the particular assembly engage the slotted bracket 180 and the washer associated with the assembly enters the nip between idler rollers 292, 294. Thereafter, the computer sends a meter actuation signal to D.C. motor 268 which raises the washer 306, and hence the pump rod 136 connected thereto a predetermined height by which a quantity of colorant extracted from container 52 is metered to within close tolerance limits according to the programmed paint formulation. When the upstroke of the pump rod 136 is completed, the D.C. motor 190 is again activated to further rotate valve shaft 140, thereby isolating the pump from container 52, and opening a passageway through which the contents of the pump can be discharged into a paint bucket or the like receptacle disposed on platform 30. Further meter actuation signals are then sent to stepper motor 268 to lower the washer 306 to the rest position illustrated in FIG. 2, for example. Upon discharge of the metered colorant in pump 134, additional valve actuation signals are sent to D.C. motor 190 so as to raise the slotted bracket 180, thereby allowing the valve shaft 140 to rotate in a counterclockwise direction under the force of coil spring 144. Alternatively, the slotted bracket 180 can be raised to engage the idler roller 230 so as to force the crank arm associated with the valve to a fully closed position, such as that illustrated in FIG. 5. The computer keeps track of the colorants which have been dispensed, and reviews the paint formulation to see if additional colorants are needed. If they are, the turntable is scanned for the location is the closest container assembly holding colorant which is required by the formulation. The indexing, metering and dispensing steps are repeated as many times as are required until all colorants required by the formulation have been dispensed.

According to one aspect of the present invention, the paint formulations are stored on a magnetic storage media and the computer 18 is programmed for fully automatic reading of the stored information, without requiring intervention by an operator of the paint colorant and dispensing apparatus. In this manner, paint formulations for entire families of paint colors and for different paint product lines can be quickly and easily disseminated to a large number of users.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Apparatus for coloring paint base material, comprising:

a plurality of container assemblies for carrying paint colorant materials;

a dispensing station, adjacent a path of travel of said container assemblies, whereat colorant materials carried by said container assemblies are dispensed into the paint base material;

said container assemblies including metering means associated with each container assembly, actuable to receive a preselected amount of colorant material from the associated container assembly and to discharge said preselected amount into the paint base material;

said container assemblies further including valve means associated with each metering means, actuable to block the discharge of colorant material from said metering means into said paint base material;

conveyor means for mounting said container assemblies for movement along said path of travel;

meter actuating means engageable with the metering means of said plurality of container assemblies to actuate said metering means so as to receive a preselectedly metered quantity of colorant material from the associated container assembly and to discharge said colorant material into the paint base material;

valve actuating means engageable with the valve means of said plurality of container assemblies to actuate said valve means so as to open and close said valve means to selectively permit discharge of said colorant into the paint base material; and indexing means for indexing said conveyor means so as to present a preselected container assembly to said dispensing station.

2. The apparatus of claim 1 wherein said conveyor means comprises a turntable for mounting said plurality of container assemblies and for carrying said container assemblies along a circular path of travel as said turntable is rotatably indexed by said indexing means.

3. The apparatus of claim 2 wherein said metering means and said valve means each include projections for engagement with said meter actuating means and said valve actuating means when the container assembly associated with said metering means and said valve means is positioned at said dispensing station.

4. The apparatus of claim 3 wherein said valve actuating means and said meter actuating means define projection-receiving recesses extending along the path of container assembly travel so as to allow the passage of non-selected container assemblies therethrough while disposing said valve actuating and said meter actuating means immediately adjacent the projections of said valve means and said meter means of selected container assemblies disposed at said dispensing station.

5. The apparatus of claim 1 wherein said dispensing means includes a support structure for mounting said valve actuating means and said meter actuating means, one on top of the other.

6. The apparatus of claim 1 wherein said valve actuating means includes first guide rail means, a first travelling head mounted on said first guide rail means for reciprocation therealong, and first bracket means carried on said travelling head for engaging the valve means of said container assemblies and for actuating said valve means as said first bracket means is displaced by said travelling head travelling along said first guide rail means.

7. The apparatus of claim 6 wherein said valve means each include a rotating shaft, an outwardly projecting arm mounted for rotation with said shaft and having roller means mounted thereon and said first bracket means includes at least one surface for engaging said roller means so as to rotate said shaft.

8. The apparatus of claim 7 wherein said valve means further includes bias means for biasing the valve shaft in a direction for closing said valve, said biasing means maintaining engagement with said at least one bracket surface as said first travelling head is reciprocated along said first guide rail means.

9. The apparatus of claim 1 wherein the valve actuating means include first drive belt means, first driving means for driving the first drive belt means in opposite directions along a path which includes a vertically extending portion, and means for attaching said first travelling head to said first drive belt means so as to reciprocate said first travelling head as said first drive belt means is driven in opposite directions.

10. The apparatus of claim 1 wherein metering means includes an actuating rod and a circular disk attached to said rod so as to project outwardly therefrom, and said meter actuating means comprises a pair of rollers attached to said second travelling head so as to form a disk-receiving opening therebetween.

11. The apparatus of claim 10 wherein said meter actuating means includes a second guide rail means, a second travelling head mounted on said second guide rail means for reciprocation therealong, and second bracket means carried on said second travelling head for engaging said metering means and for actuating said metering means as said second bracket means is displaced by said second travelling head travelling along said second guide rail means.

12. The apparatus of claim 11 wherein the meter actuating means include second drive belt means, second driving means for driving the second drive belt means in opposite directions along a path which includes a vertically extending portion, and means for attaching said second travelling head to said second drive belt means so as to reciprocate said second travelling head as said second drive belt means is driven in opposite directions.

13. The apparatus of claim 1 further comprising electronic control means including means for storing at least one formula for coloring a paint base material including a programmed amount of at least one colorant material, means for generating a sequence of indexing, discharge, and metering signals so as to discharge a programmed amount of said at least one colorant material into said paint base material according to the paint formula.

14. The apparatus of claim 13 wherein said valve actuating means include means for receiving a valving signal and responsive to said valving signal to actuate said valving means.

15. The apparatus of claim 13 wherein said meter actuating means include means for receiving a metering signal and is responsive to said metering signal to actuate said metering means.

16. The apparatus of claim 13 wherein said electronic control means includes means for sensing, in a sequence of container assemblies passing said dispensing station, a first container assembly of said container assemblies holding colorant specified by the formula stored therein and for stopping said indexing means so as to position said, first container assembly at said dispensing station, and discharge and metering signals said control means generating said and means for sending additional indexing signals to said indexing means to resume indexing a sequence of said container assemblies past said dispensing station and to identify the next container assembly holding a colorant specified in said formula.

17. The apparatus of claim 1 further comprising rotatably driven agitation means for agitating the material in each said container, and agitator drive means for driving a plurality of said agitation means;

18. Apparatus for automatically coloring a container of paint base material with at least one colorant material, according to a predefined formula, comprising:

a plurality of container assemblies for carrying paint colorant materials;

a dispensing station, adjacent a path of travel of said container assemblies, whereat colorant materials carried by said container assemblies are dispensed into the paint base material;

said container assemblies including metering means associated with each container assembly, to receive a preselected amount of colorant material from the associated assembly container and to discharge said preselected amount into the paint base material;

said container assemblies further including valve means associated with each metering means, to block the discharge of colorant material from said metering means into said paint base material;

conveyor means for mounting said container assemblies for movement along said path of travel;

meter actuating means operable in response to a metering signal to engage the metering means of said plurality of container assemblies so as to actuate said metering means to receive a preselectedly metered quantity of colorant material from the associated container assembly and responsive to a discharge signal to discharge said colorant material into the paint base material;

valve actuating means operable in response to an actuating signal to engage the valve means of said plurality of container assemblies so as to actuate said valve means to open and close said valve means so as to selectively permit discharge of said colorant into the paint base material;

indexing means for indexing said conveyor means so as to present a preselected container assembly to said dispensing station; and electronic control means including means for storing at least one formula for coloring a paint base material with a programmed amount of at least one colorant material, means for generating a sequence of indexing, actuating, discharge, and metering signals so as to discharge a programmed amount of said at least one colorant material into said paint base material according to the paint formula.

19. The apparatus of claim 18 wherein said electronic control means includes means for storing a multiple color formula for coloring a paint base material and means for adding a plurality of different colorant materials to the paint base material, wherein said electronic control means including means for indexing said turntable to register the nearest container assembly containing material specified by the formula with the container, for deriving from said formula, a metering signal for metering a specified amount of the material in the registered container assembly and said electronic control means for including means for avoiding repeating a further addition of the colorant material in said registered container to the paint base upon a subsequent indexing of said turntable.

20. The apparatus of claim 18 wherein said conveyor means comprises a turntable for mounting said plurality of container assemblies and for carrying said container assemblies along a circular path of travel as said turntable is rotatably indexed by said indexing means.

21. The apparatus of claim 20 wherein said metering means and said valve means each include projections for engagement with said meter actuating means and said valve actuating means when the container assembly associated with said metering means and said valve means is positioned at said dispensing station.

22. The apparatus of claim 21 wherein said valve actuating means and said meter actuating means define projection-receiving recesses extending along the path of container assembly travel so as to allow the passage of non-selected container assemblies therethrough while disposing said valve actuating and said meter actuating means immediately adjacent the projections of said valve means and said meter means of selected container assemblies disposed at said dispensing station.

23. The apparatus of claim 18 further comprising rotatably driven agitation means for agitating the material in each said container, and agitator drive means for driving a plurality of said agitation means, said agitator drive means mounted on a pedestal above said conveyor means, adjacent said valve and said meter actuation means.

24. The apparatus of claim 1 wherein said dispensing means includes a support structure for mounting said valve actuating means and said meter actuating means, one on top of the other.

25. The apparatus of claim 24 further comprising a movable stand beneath said conveyor means at said delivery station for supporting said container of base paint material of different sizes beneath container assemblies indexed to said delivery station.

26. The apparatus of claim 18 wherein said valve actuating means includes first guide rail means, a first travelling head mounted on said first guide rail means for reciprocation therealong, and first bracket means carried on said travelling head for engaging the valve means of said container assemblies and for actuating said valve means as said first bracket means is displaced by said travelling head travelling along said first guide rail means.

27. The apparatus of claim 26 wherein said valve means each include a rotating shaft, an outwardly projecting arm mounted for rotation with said shaft and having roller means mounted thereon and said first bracket means includes at least one surface for engaging said roller means so as to rotate said shaft.

28. The apparatus of claim 27 wherein said valve means further includes bias means for biasing the valve shaft in a direction for closing said valve, said biasing means maintaining engagement with said at least one bracket surface as said first travelling head is reciprocated along said first guide rail means.

29. The apparatus of claim 18 wherein the valve actuating means include first drive belt means, first driving means for driving the first drive belt means in opposite directions along a path which includes a vertically extending portion, and means for attaching said first travelling head to said first drive belt means so as to reciprocate said first travelling head as said first drive belt means is driven in opposite directions.

30. The apparatus of claim 18 wherein metering means includes an actuating rod and a circular disk attached to said rod so as to project outwardly therefrom, and said meter actuating means comprises a pair of rollers attached to said second travelling head so as to form a disk-receiving opening therebetween.

31. The apparatus of claim 30 wherein said meter actuating means includes a second guide rail means, a second travelling head mounted on said second guide rail means for reciprocation therealong, and second bracket means carried on said second travelling head for engaging said metering means and for actuating said metering means as said second bracket means is displaced by said second travelling head travelling along said second guide rail means.

32. The apparatus of claim 31 wherein the meter actuating means include second drive belt means, second driving means for driving the second drive belt means in opposite directions along a path which includes a vertically extending portion, and means for attaching said second travelling head to said second drive belt means so as to reciprocate said second travelling head as said second drive belt means is driven in opposite directions.

* * * * *

UNITED STATES PATENT AND TRADEMARK OFFICE

CERTIFICATE OF CORRECTION

PATENT NO. : 4,967,938

DATED : November 6, 1990

INVENTOR(S) : Leen Hellenberg

It is certified that error appears in the above-identified patent and that said Letters Patent is hereby corrected as shown below:

In Column 1, line 24, change "Nos." to read --No.--.

In Column 3, line 22, delete the phrase --has been inserted--.

In Column 3, line 41, change "which" to read the word --with--.

In Column 4, line 37, delete the slash mark --/--.

In Column 4, line 38, delete the slash mark --/--.

In Column 6, line 23, after the word "means" insert the word --includes--.

In Column 13, line 25, change the word "is" to read the word --of--.

In Column 15, lines 50 and 51, Claim 16, change "discharge and metering signals said control means generating said" to read --said control means generating said discharge and metering signals--.

In Column 15, line 59, Claim 17, change the semicolon ";" to a period --.--.

In Column 16, line 4, Claim 18, change the phrase "assembly container" to read --container assembly--.

In Column 16, line 48, Claim 19, delete the word --for-- (first occurrence).

UNITED STATES PATENT AND TRADEMARK OFFICE

CERTIFICATE OF CORRECTION

PATENT NO. : 4,967,938

DATED : November 6, 1990

INVENTOR(S) : Leen Hellenberg

It is certified that error appears in the above-identified patent and that said Letters Patent is hereby corrected as shown below:

In Column 16, line 50, Claim 19, after the word "container" insert the word --assembly--.

Signed and Sealed this

Nineteenth Day of May, 1992

*Attest:*

DOUGLAS B. COMER

*Attesting Officer*

*Acting Commissioner of Patents and Trademarks*